US007614579B2

(12) United States Patent
Asano

(10) Patent No.: US 7,614,579 B2
(45) Date of Patent: Nov. 10, 2009

(54) WIRING APPARATUS

(75) Inventor: Mitsutoshi Asano, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 51 days.

(21) Appl. No.: 12/084,435

(22) PCT Filed: Nov. 2, 2006

(86) PCT No.: PCT/JP2006/322426

§ 371 (c)(1),
(2), (4) Date: May 1, 2008

(87) PCT Pub. No.: WO2007/074586

PCT Pub. Date: Jul. 5, 2007

(65) Prior Publication Data

US 2009/0159736 A1 Jun. 25, 2009

(30) Foreign Application Priority Data

Dec. 26, 2005 (JP) ..... 2005-373448

(51) Int. Cl.
*B21C 47/14* (2006.01)

(52) U.S. Cl. ..... 242/439.1; 242/437.3; 242/439.5

(58) Field of Classification Search ..... 242/437.3, 242/439.1, 439.2, 439.5, 441.1
See application file for complete search history.

(56) References Cited

U.S. PATENT DOCUMENTS

| | | | | |
|---|---|---|---|---|
| 4,362,541 | A * | 12/1982 | Thompson | 65/478 |
| 6,102,324 | A * | 8/2000 | Farrow et al. | 242/437.2 |
| 6,499,689 | B1 | 12/2002 | Miyazaki | |
| 6,679,449 | B2 * | 1/2004 | Sugiuchi | 242/439.1 |
| 7,201,344 | B2 * | 4/2007 | Higeta | 242/437 |
| 2006/0196984 | A1 * | 9/2006 | Higeta | 242/176 |

FOREIGN PATENT DOCUMENTS

| | | |
|---|---|---|
| JP | 02 262861 A | 10/1990 |
| JP | 11-283856 | 10/1999 |
| JP | 2000-348959 | 12/2000 |
| JP | 2004-119922 A | 4/2004 |
| JP | 2004-328962 | 11/2004 |

* cited by examiner

*Primary Examiner*—Emmanuel M Marcelo
(74) *Attorney, Agent, or Firm*—Kenyon & Kenyon LLP

(57) ABSTRACT

A winding apparatus comprises first and second nozzles, each of which is configured to allow two wires to pass therethrough, and a nozzle holder which holds the nozzles in parallel with each other. A total of four wires is supplied and regularly wound on a bobbin. A first motor, a driven gear, and a drive gear are provided to rotate the nozzle holder about its axis substantially parallel to the nozzles. The nozzle holder holds the nozzles separately to be rotatable about respective axes. Second and third motors, driven gears, and drive gears are provided for rotating the nozzles about respective axes.

3 Claims, 10 Drawing Sheets

WIRING APPARATUS

This is a 371 national phase application of PCT/JP2006/322426 filed 2 Nov. 2006, claiming priority to Japanese Patent Application No. 2005-373448 filed 26 Dec. 2005, the contents of which are incorporated herein by reference.

TECHNICAL FIELD

The present invention relates to an apparatus for regularly winding a plurality of wires on a bobbin to manufacture a coil.

BACKGROUND ART

This type of apparatus has been known as a winding apparatus disclosed in each of Japanese unexamined patent publication No. 2004-119922, Japanese Patent No. 3,140,729, Japanese unexamined patent publication No. 2004-328962, and Japanese unexamined patent publication No. 2000-348959. Of them, for example, the publication '922 discloses a winding apparatus structured to include two or three rotatable nozzles through which wires are supplied and to manufacture both a multi-layered coil and a parallel coil. Those two or three nozzles are retained by a rotatable nozzle holder. When a bobbin is rotated while the wires are unreeled to be supplied through the nozzles, the wires are wound on the bobbin. In synchronism with the rotation of the bobbin, the nozzle holder is rotated to rotate the two or three nozzles about a predetermined rotation center, thereby winding the two or three wires together in multilayered or parallel relation on the periphery of the bobbin.

DISCLOSURE OF INVENTION

Problems to be Solved by the Invention

The publication '922 discloses the winding apparatus structured to simultaneously wind two or three wires; however, it has no disclosure or suggestion about a technique of simultaneously winding more than three wires. To manufacture a coil by winding wires on a bobbin to produce high power, the coil needs to have a minimum sectional area. In terms of productivity of coils, it is preferable that three or more wires are simultaneously wound on a bobbin. In terms of miniaturization of coils, additionally, it is preferable that a single apparatus can provide various winding methods or patterns.

The present invention has been made in view of the above circumstances and has an object to provide a winding apparatus capable of simultaneously winding three or more wires and providing various winding methods.

Means for Solving the Problems

To achieve the above object, the present invention according to one aspect provides a winding apparatus comprising a plurality of nozzles through which wires are supplied to a bobbin, and a nozzle holder which holds the plurality of nozzles, the winding apparatus being arranged to supply the wires through the plurality of nozzles to regularly wind the wires on the bobbin, wherein the winding apparatus further comprises: first rotation means for rotating the nozzle holder about its axis substantially parallel to the plurality of nozzles, at least one of the plurality of nozzles being a multiple-wire nozzle through which a plurality of the wires is supplied, and the multiple-wire nozzle being held rotatably about its axis by the nozzle holder, and second rotation means for rotating the multiple-wire nozzle about the axis thereof.

According to the above structure, the first rotation means and the second rotation means are separately controlled. It is therefore possible to change the rotation angles of the nozzle holder and the multiple-wire nozzle respectively, thereby changing the position of the wire supplied through each nozzle relative to the bobbin.

This makes it possible to simultaneously wind three or more wires and thus provide various winding methods incorporating different wire lane changes.

In the above winding apparatus, preferably, the plurality of nozzles is all the multiple-wire nozzles, and each multiple-wire nozzle includes the second rotation means.

According to the above structure, the first rotation means and the second rotation means are separately controlled. It is therefore possible to change the rotation angles of the nozzle holder and the plurality of the multiple-wire nozzles respectively, thereby changing the positions of the wires supplied through the plurality of the multiple-wire nozzles relative to the bobbin.

This makes it possible to simultaneously wind four or more wires and thus provide various winding patterns incorporating different wire lane changes.

In the above winding apparatus, further preferably, the multiple-wire nozzles are provided two, each of which is configured to allow two wires to pass therethrough.

According to the above structure, the first rotation means and the second rotation means are separately controlled. It is therefore possible to change the rotation angles of the nozzle holder and the two multiple-wire nozzles respectively, thereby changing the positions of a pair of two wires and another pair of two wired unreeled to be supplied to the bobbin through the two nozzles relative to the bobbin.

This makes it possible to simultaneously wind four or more wires and thus provide various winding patterns incorporating different wire lane changes.

BEST MODE FOR CARRYING OUT THE INVENTION

A detailed description of a preferred embodiment of a winding apparatus of the present invention will now be given referring to the accompanying drawings. The present embodiment exemplifies a winding apparatus for manufacturing a rectangular coil unit by simultaneously regularly winding four wires on a bobbin.

Figure 5:
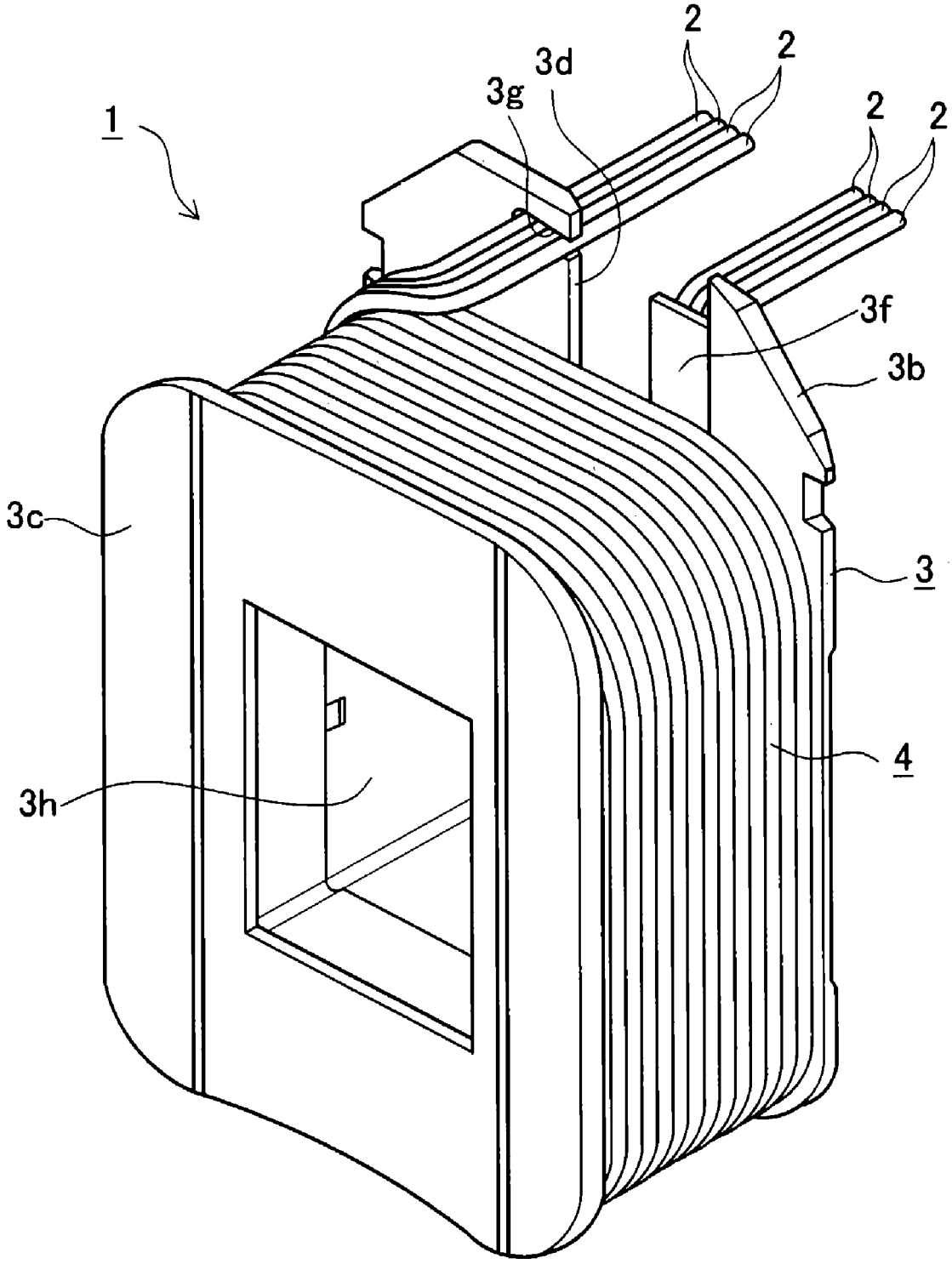
FIG. 5 is a perspective view of a rectangular coil unit.
Figure 6:
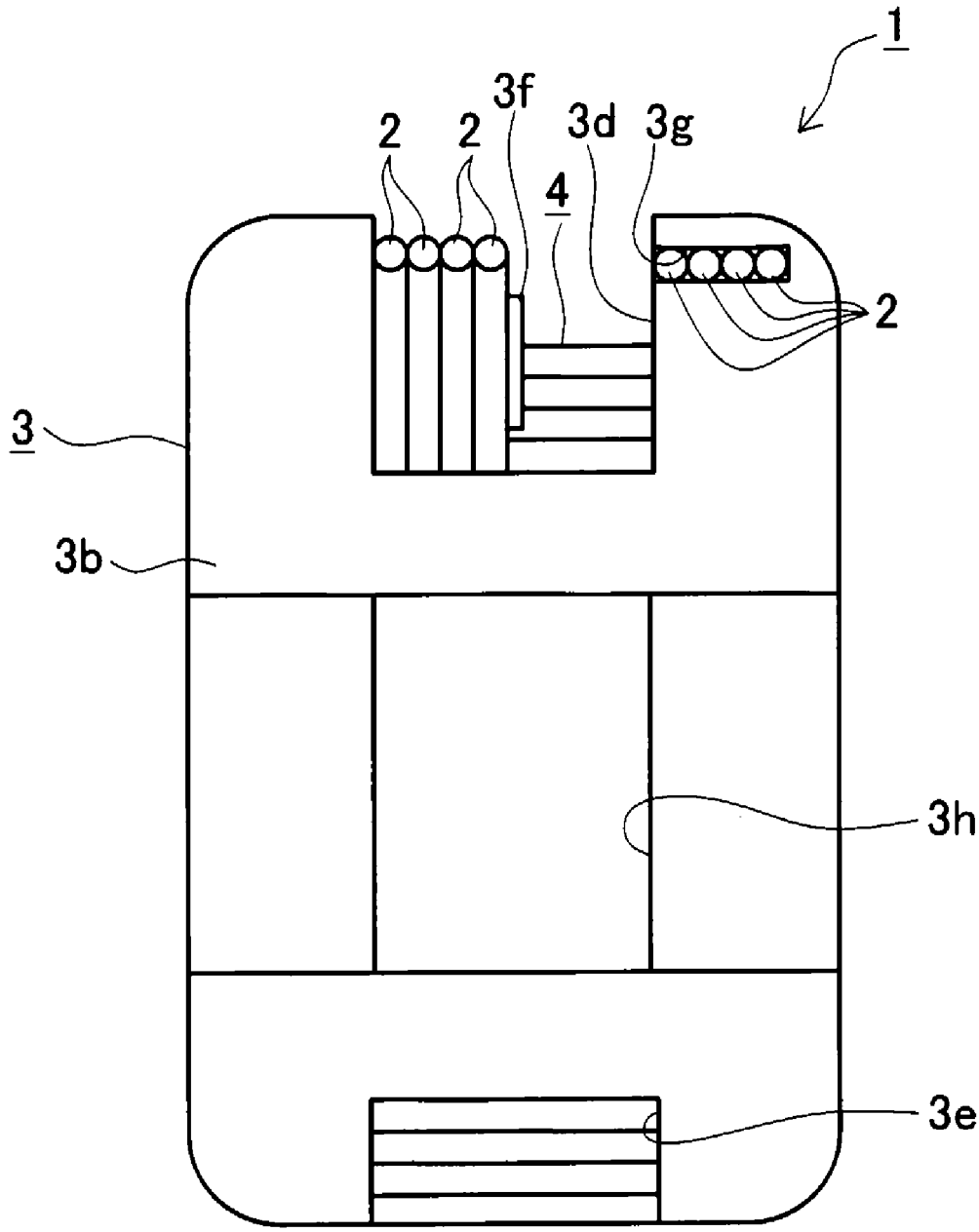
FIG. 6 is a back view of the rectangular coil unit.
Figure 7:
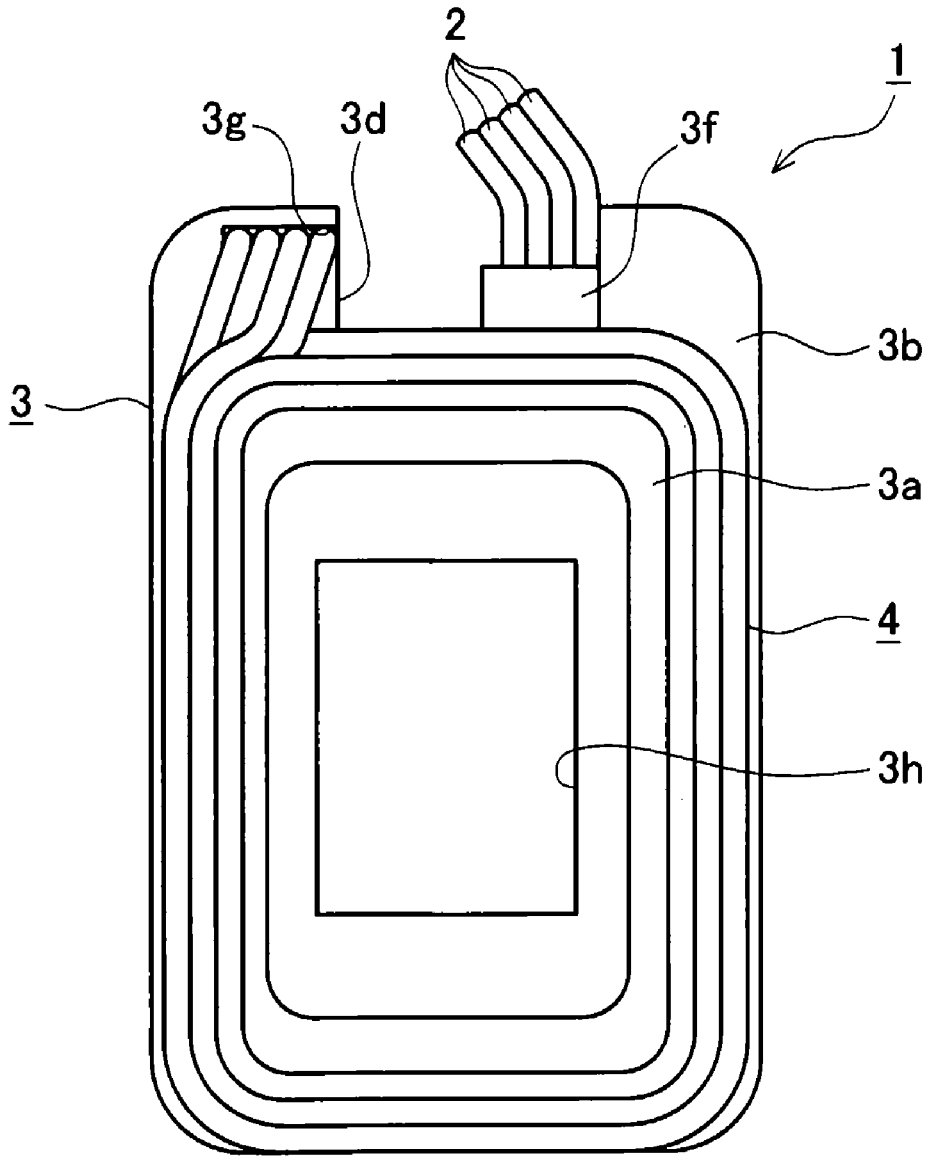
FIG. 7 is a front view of the rectangular coil unit with a first flange omitted.

Herein, a rectangular coil unit to be manufactured by a wiring apparatus will be described prior to explanation of the wiring apparatus. FIG. 5 is a perspective view of a rectangular coil unit 1 in the present embodiment. FIG. 6 is a back view of the rectangular coil unit 1. FIG. 7 is a front view of the rectangular coil unit 1 from which a first flange is removed for convenience of explanation. The rectangular coil unit 1 in the present embodiment is manufactured in such a manner that four wires 2 are simultaneously regularly wound on four outer surfaces of a bobbin 3 having a rectangular section. A plurality of such rectangular coil units 1 will be mounted in a plurality of teeth formed on the inner periphery of a stator core, thus constituting a stator. This stator is further assembled with a rotor, producing a motor.

The bobbin 3 includes a core tube 3*a* of a rectangular section, a first flange 3*b* and a second flange 3*c* formed at both axial ends of the core tube 3*a*. The bobbin 3 is made of a synthetic resin such as PPS (polyphenylene sulfide) to have an insulating property. The first flange 3*b* provided on a rear side has a distinctive shape as compared with the second flange 3*c* provided on a front side having a nearly normal rectangular shape. Specifically, the first flange 3*b* includes upper and lower cutout portions 3*d* and 3*e*, an insulating wall 3*f* protruding from one of side surfaces of the upper cutout portion 3*d* in FIG. 7 toward the other side surface, and a stopper groove 3*g* formed in the upper portion. The core tube 3*a* is hollow, providing a center hole 3*h*. A clearance is formed between the insulating wall 3*f* and a lower surface of the upper cutout portion 3*d* as shown in FIG. 6. Onto the core tube 3*a*, four wires 2 are simultaneously regularly wound, forming a coil 4 having a hollow rectangular shape. Both end portions of each of four wires 2 are partly engaged with the insulating wall 3*f* and the stopper groove 3*g*. In the present embodiment, a relatively thick wire 2 is used to achieve a small-sized high power motor. The wire 2 is made of a copper wire coated with an enamel insulating film.

In the above rectangular coil unit 1, four wires 2 are guided onto the core tube 3*a* inside the first flange 3*b* through the clearance between the insulating wall 3*f* and the lower surface of the cutout portion 3*d*. Those four wires 2 are sequentially wound in a row on the core tube 3*a* in a direction advancing from the first flange 3*b* to the second flange 3*c*, forming a first layer. Then, the wires 2 are turned (folded) back along the second flange 3*c* and sequentially wound in a row on the first layer in a direction opposite to that for the first layer from the second flange 3*c* to the first flange 3*b*, forming a second layer. The four wires 2 are wound regularly and reciprocally in opposite directions along the axis of the core tube 3*a* as above, forming the coil 4 with a plurality of rows and a plurality of layers of wires. After winding, the end portions of the two wires 2 are engaged in the stopper groove 3*g*. The rectangular coil unit 1 including the coil 4 formed in the above manner to have a rectangular section is thus manufactured.

Figure 8:
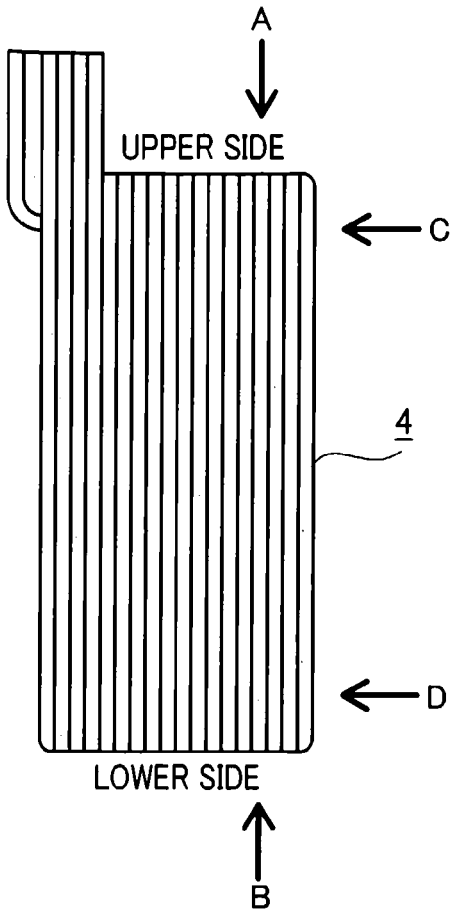
FIG. 8 is a side view of a coil on a bobbin.
Figure 9:
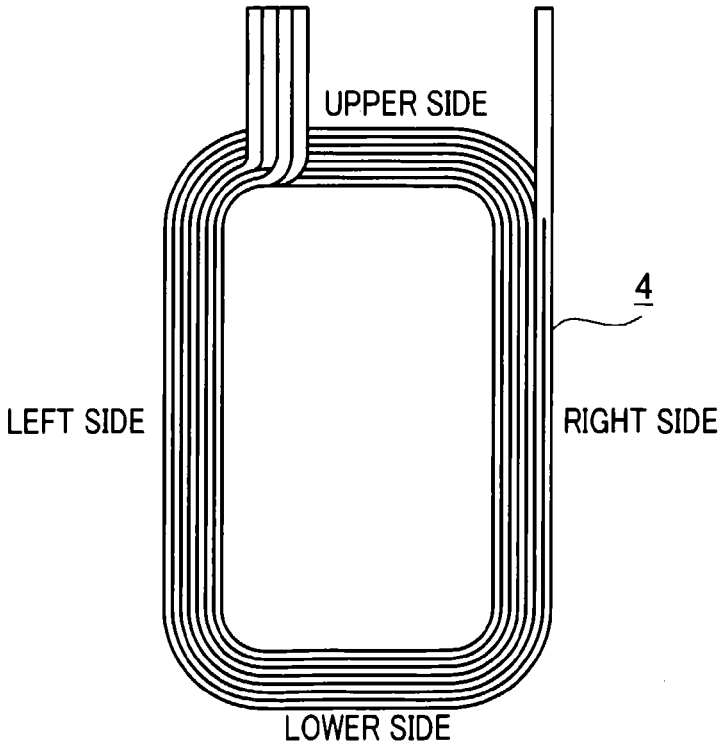
FIG. 9 is a back view of the coil on the bobbin.

FIG. 8 is a side view of the coil 4 on the bobbin 3. FIG. 9 is a back view of the coil 4 on the bobbin 3. FIGS. 10A to 10D are views seen from directions indicated by arrows A, B, C, and D in FIG. 8 respectively. FIG. 11 is a pattern diagram showing the arrangement of the coil 4 on the bobbin 3. As shown in FIGS. 8 to 11, in the present embodiment, the four wires 2 are wound in such a manner as to advance obliquely together for a lane change corresponding to 2 wires (i.e. two wire diameters) on a lower surface side of the core tube 3*a* of the bobbin 3 having four outer surfaces including a pair of upper and lower surfaces and to advance obliquely together for a lane change corresponding to 2 wires (i.e. two wire diameters) (hereinafter, "2-wire lane change") on an upper surface side thereof (hereinafter, this winding method is referred to as "2-2 change"). In this way, a lane change corresponding to 4 wires is performed on the upper and lower sides of the bobbin 3.

Figure 10A:
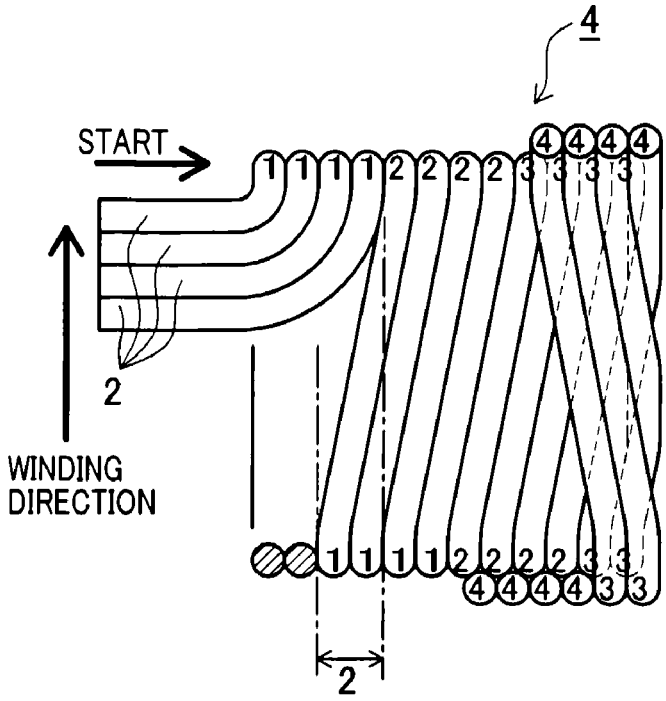
FIGS. 10A to 10D are views seen from directions indicated by arrows A, B, C, and D in FIG. 8.
Figure 10C:
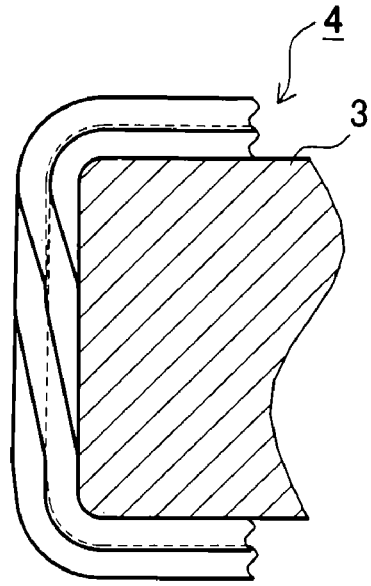
Figure 10B:
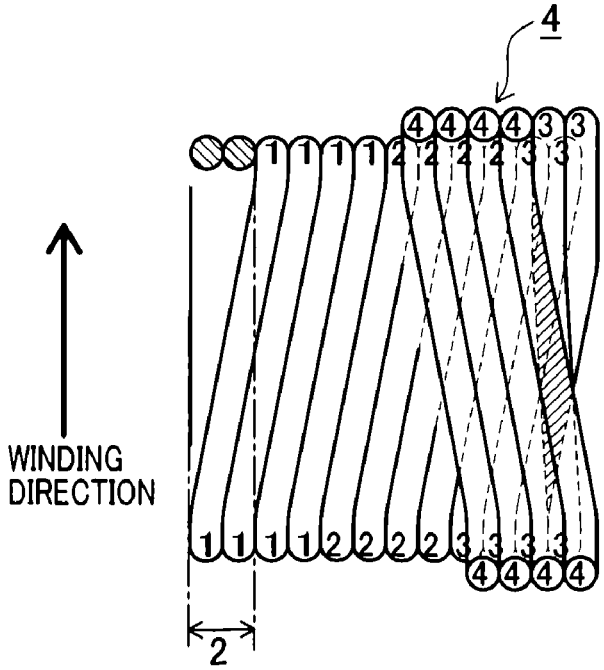
Figure 10D:
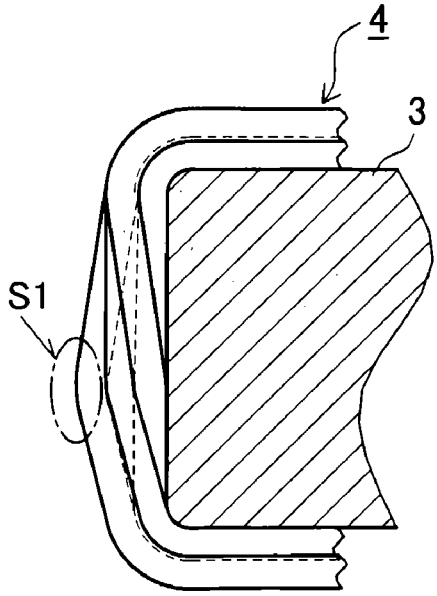
Figure 11:
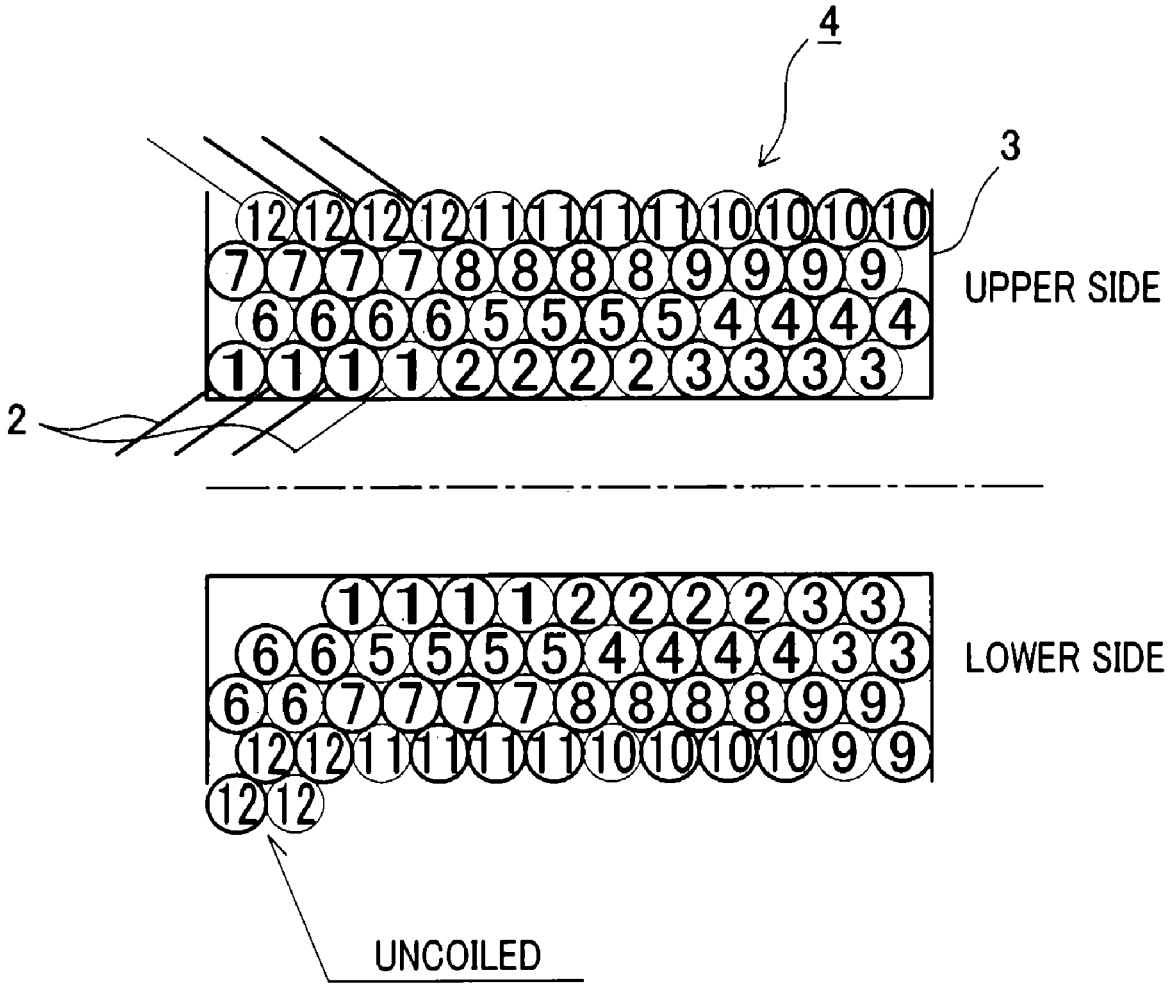
FIG. 11 is a pattern diagram showing arrangement of the coil on the bobbin.

To be concrete, as indicated by number "1" (representing the first turn of the wires 2) in FIGS. 8, 9, and 10A, four wires 2 start to be wound from an upper side and along the first flange 3*b* to a left side, and then vertically downward to a lower side. Successively, the wires 2 advance obliquely together for the 2-wire lane change on the lower side, as indicated by number "1" in FIG. 10B, and then vertically upward on a right side to the upper side. As indicated by numbers "1" and "2" in FIG. 10A, on the upper side, the wires 2 advance obliquely together for the 2-wire lane change and vertically downward again on the left side to the lower side. Thereafter, the above lane changes are repeated as in the above manner on the upper side and the lower side. The first layer of the coil 4 is thus formed (the first layer has 3 turns as indicated by numbers "1" to "3" in FIGS. 10A and 10B). After completion of a winding operation for the first layer, the wires 2 are turned (folded) back at an opposite position from the winding start position. On the lower side, the 2-wire lane change is performed in a direction opposite to that for the first layer as shown in FIG. 10B. On the upper-side, the 2-wire lane change is performed in the direction opposite to that the first layer as shown in FIG. 10A. According to this winding method, the four wires 2 are twisted 90° at the turn-back of the winding operation and hence the wires 2 intersect to overlap each other as shown in FIG. 10D as a shaded area shown in FIG. 10B. As shown in FIG. 11, when the winding is completed at the end of the bobbin 3, two of the four wires 2 are left uncoiled in that winding end position.

Figure 1:
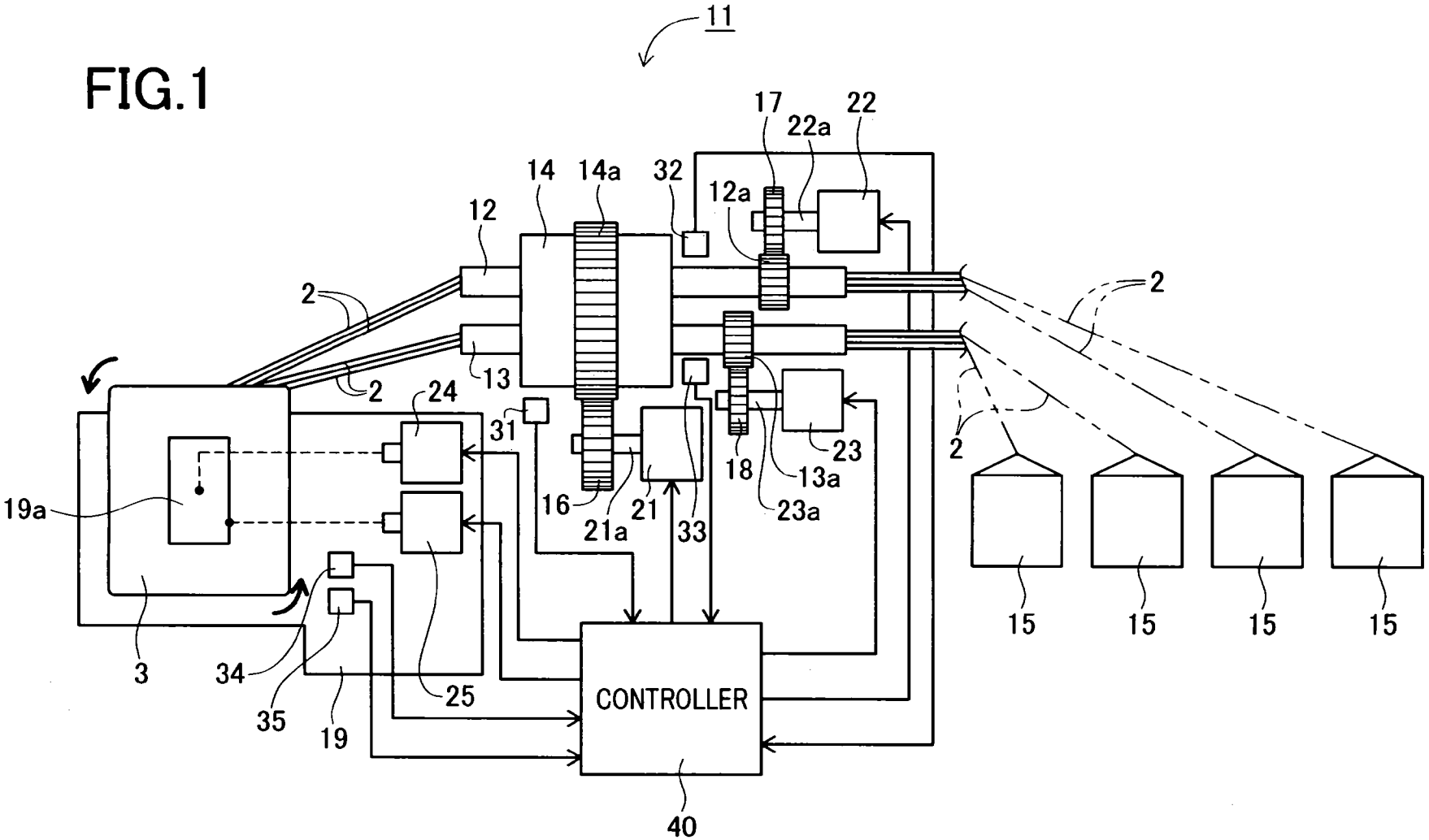
FIG. 1 is a schematic configuration view of a winding apparatus.

The winding apparatus will be explained below to carry out the aforementioned "2-2 change" winding method. FIG. 1 shows a schematic configuration view of a winding apparatus 11. This winding apparatus 11 comprises two nozzles (first nozzle 12 and second nozzle 13), each of which is configured to allow two wires 2 to pass therethrough to be supplied to the bobbin 3, and a columnar nozzle holder 14 holding the two nozzles 12 and 13 in parallel. The winding apparatus 11 is structured to supply a total of four wires 2 through the two nozzles 12 and 13 and wind them on the bobbin 3 to form the coil 4. The axes of the nozzles 12 and 13 and the axis of the nozzle holder 14 are substantially parallel to each other. The nozzles 12 and 13 are held in and through the nozzle holder 14 so as to be rotatable relative to the nozzle holder 14. The wires 2 to be supplied through the nozzles 12 and 13 are unreeled from separate wire drums 15 respectively. In the present embodiment, the first and second nozzles 12 and 13 correspond to a multiple-wire nozzle of the present invention.

The nozzle holder 14 is integrally provided on its outer periphery with a driven gear 14*a* engaging with a drive gear 16 attached to an output-shaft 21*a* of the first motor 21. Driving the first motor 21 causes the nozzle holder 14, via the drive gear 16 and the driven gear 14*a*, to rotate about its own axis substantially parallel to the nozzles 12 and 13. In the present embodiment, the driven gear 14*a*, the drive gear 16, and the first motor 21 constitute first rotation means of the present invention. A rotation angle HA of the nozzle holder 14 is detected by a first rotation angle sensor 31.

On the peripheries of end portions of the nozzles 12 and 13, driven gears 12*a* and 13*a* are integrally provided respectively. Those driven gears 12*a* and 13*a* are coupled to drive gears 17 and 18 attached to an output shaft 22*a* of a second motor 22 and an output shaft 23*a* of a third motor 23 respectively. Driving the second motor 22 causes the first nozzle 12, via the drive gear 17 and the driven gear 12*a*; to rotate about its own axis. Similarly, driving the third motor 23 causes the second nozzle 13, via the drive gear 18 and the driven gear 13*a*, to rotate about its own axis. In the present embodiment, the driven gears 12*a* and 13*a*, the drive gears 17 and 18, the second motor 22, and the third motor 23 constitute second rotation means of the present invention. A rotation angle N1A of the first nozzle 12 is detected by a second rotation angle sensor 32. A rotation angle N2A of the second nozzle 13 is detected by a third rotation angle sensor 33.

Figure 2:
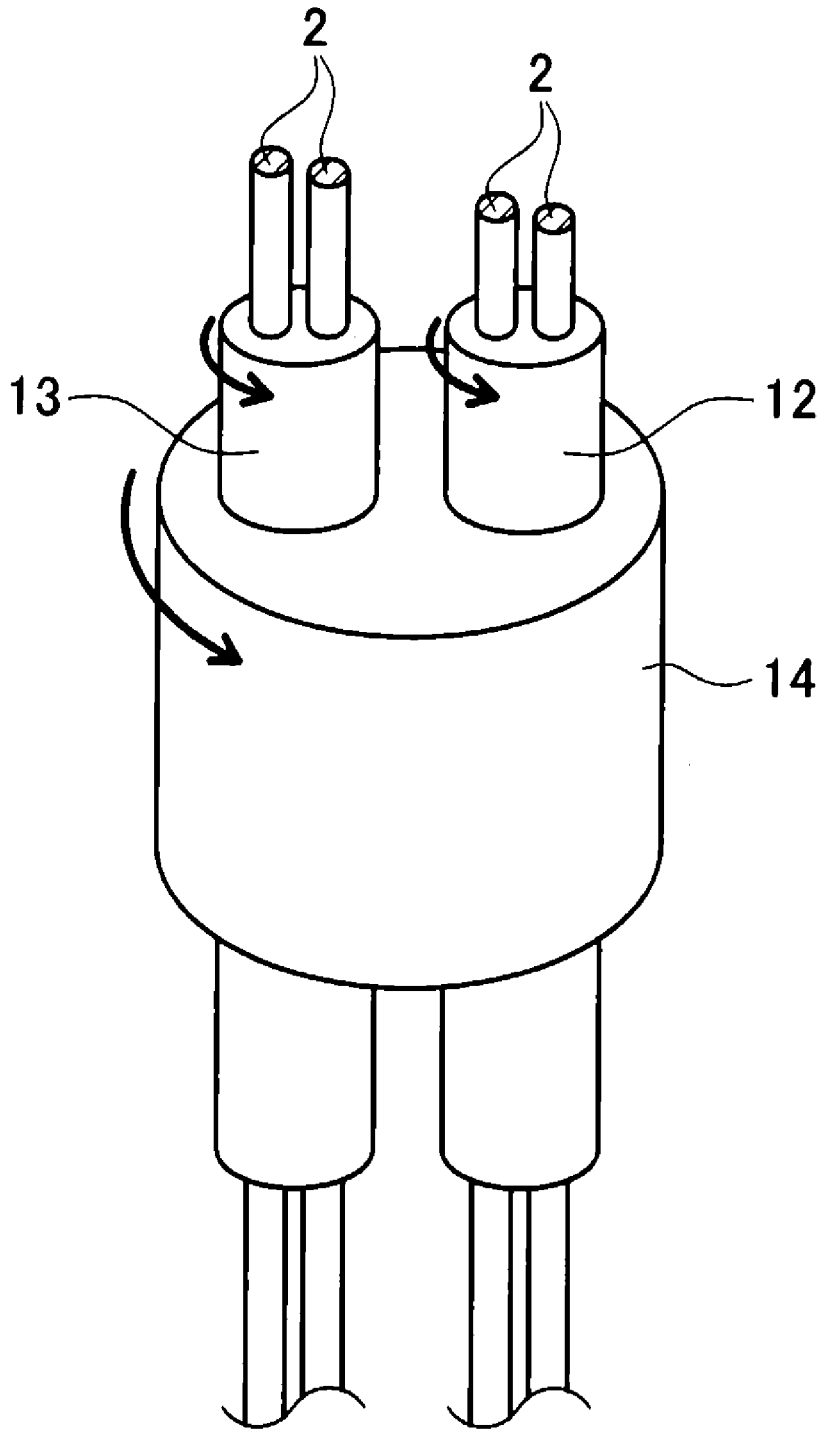
FIG. 2 is a perspective view showing a schematic configuration of a nozzle holder and each nozzle.
Figure 3A:
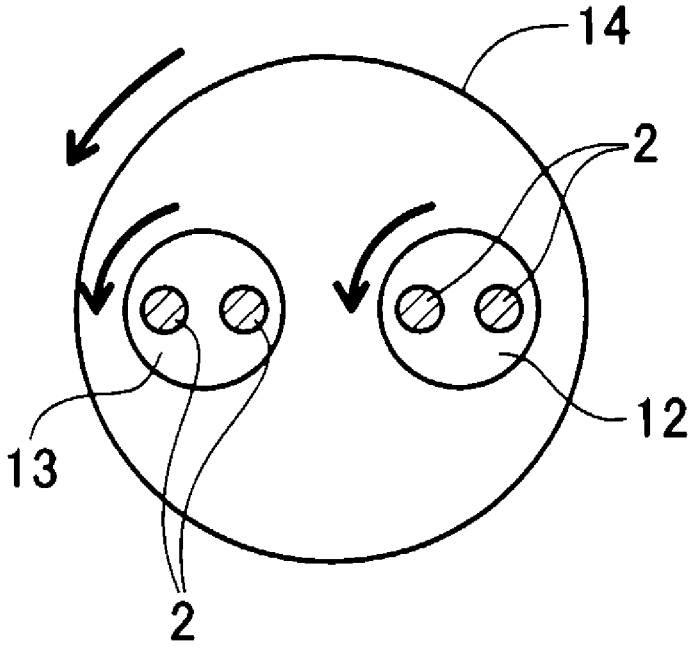
FIGS. 3A and 3B are plan views of a front end of the nozzle holder.
Figure 3B:
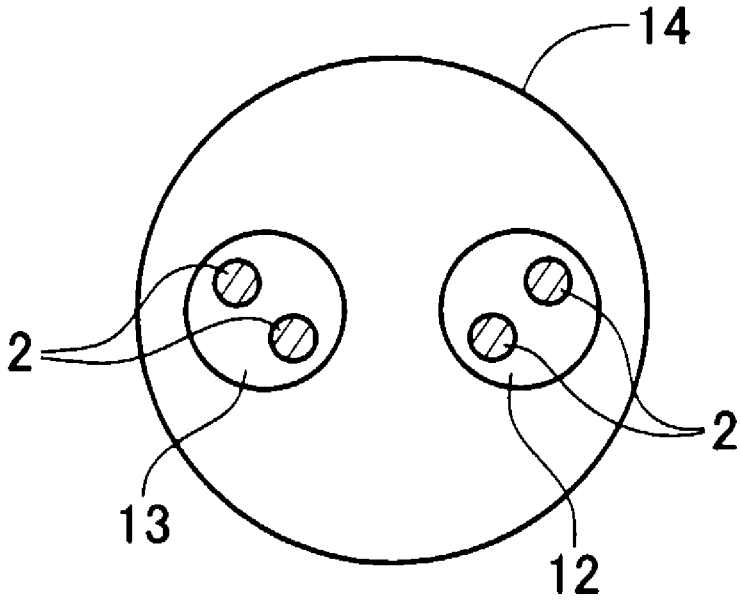

FIG. 2 is a perspective view showing a schematic configuration of the nozzle holder 14 and the nozzles 12 and 13. FIGS. 3A and 3B are plan views showing the front end of the nozzle holder 14. As shown in FIG. 2 and FIG. 3A, the nozzle holder 14, nozzles 12 and 13 are independently rotatable. When the nozzle holder 14 is rotated, the arrangement of the two nozzles 12 and 13 can be changed. For instance, the two nozzles 12 and 13 may be arranged in horizontal relation as shown in FIGS. 3A and 3B or in vertical or oblique relation. Rotation of each nozzle 12 and 13 further enables changes in the arrangement of two wires 2. For instance, two wires 2 may be arranged in horizontal relation as shown in FIG. 3A, in vertical relation, or in oblique relation as shown in FIG. 3B.

The bobbin 3 is removably fitted on a movable shaft 19*a* of a bobbin holder 19 as shown FIG. 1. This movable shaft 19*a* is configured to rotate the bobbin 3 about the axis of the shaft 19*a* and slide the bobbin 3 along the axis thereof. The bobbin holder 19 includes a fourth motor 4 and a rotation mechanism (not shown) for rotating the movable shaft 19*a* to rotate the bobbin 3, and a fifth motor 25 and a slide mechanism (not shown) for sliding the movable shaft 19*a* to slide the bobbin 3. A rotation angle of the bobbin 3 is detected by a fourth rotation angle sensor 34 provided in the bobbin holder 19. A slide position of the bobbin 3 is detected by a position sensor 35 provided in the bobbin holder 19.

As shown in FIG. 1, the motors 21 to 25 and the sensors 31 to 35 are electrically connected to a controller 40 respectively. The controller 40 controls each of the motors 21 to 23 to change the rotation angles HA, N1A, and N2A of the nozzle holder 14, the nozzle 12, and the nozzle 13, respectively. Further, the controller 40 is configured to determine the rotation angles HA, N1A, and N2A of the nozzle holder 14, the nozzle 12, and the nozzle 13 based on detection signals from the corresponding sensors 31 to 33. At the same time, the controller 40 controls the motors 24 and 25 respectively to rotate and slide the bobbin 3. The controller 40 also determines the rotation angle and the slide position of the bobbin 3 based on detection signals from the corresponding sensors 34 and 35.

Figures 4A, 4B, 4C:
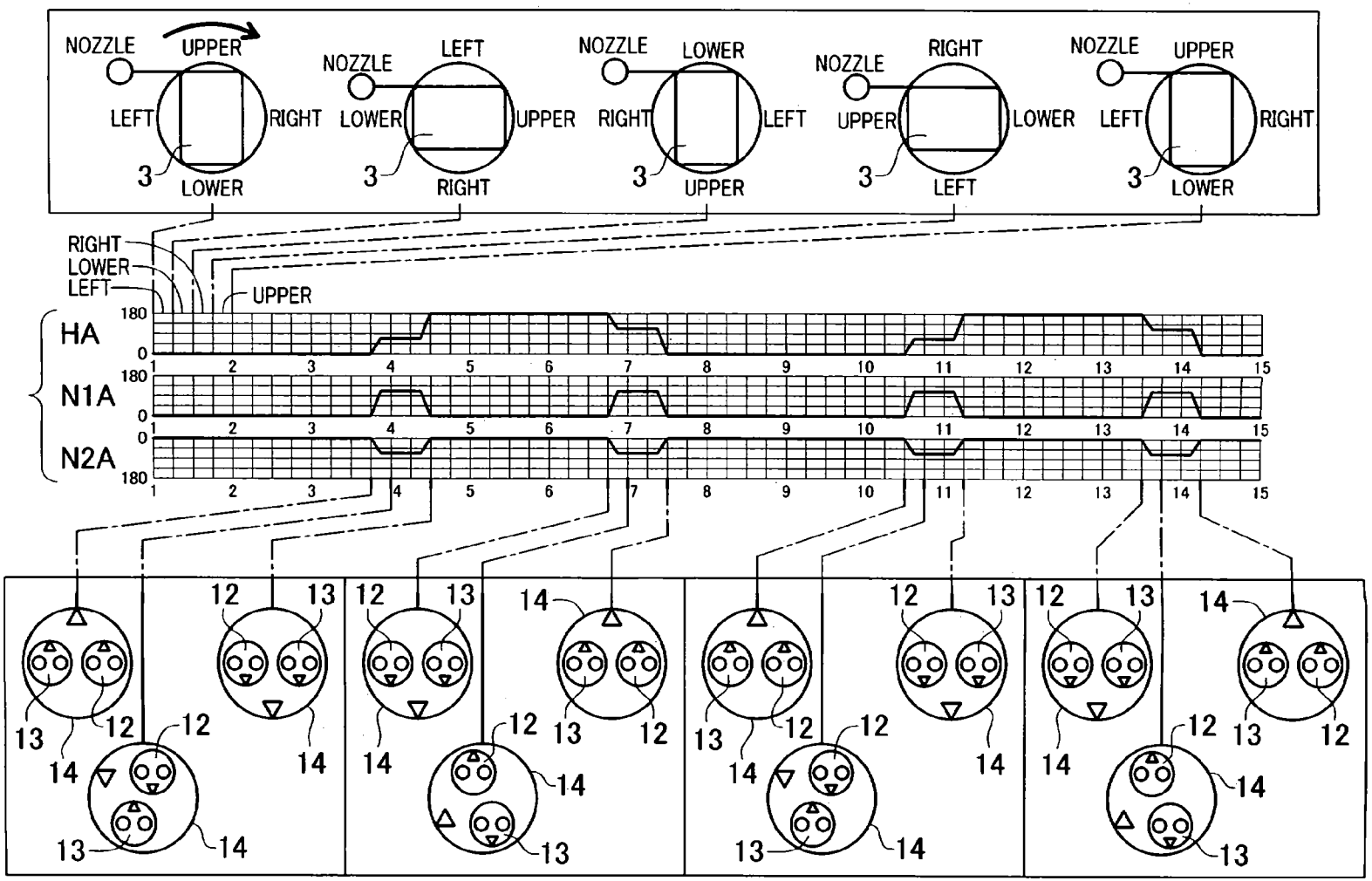
FIG. 4 is a time chart showing control particulars of each nozzle and others.

FIG. 4 is a time chart showing the control particulars to be executed by the controller 40 for the nozzles 12 and 13 and others to carry out the aforementioned "2-2 change" winding method. FIG. 4A shows changes in rotation angle of the bobbin 3 in steps of 90°. FIG. 4B shows changes in rotation angle HA of the nozzle holder 14, changes in rotation angle NIA of the first nozzle 12, and changes in rotation angle of the second nozzle 13 by associating them. The vertical axis of each frame represents the rotation angles HA, N1A, and N2A in a range of "0° to 180°". The lateral axis of each frame represents the number of rotations of the bobbin 3 in a range of "1 to 15" in the present embodiment. The line in each frame represents changes in each rotation angle HA, N1A, and N2A; Upward oblique line indicates a change to a counterclockwise direction and Downward oblique line indicates a change to a clockwise direction. FIG. 4C shows the front ends of the nozzle holder 14 and the nozzles 12 and 13. Each triangular mark in the nozzle holder 14 and the nozzles 12 and 13 indicates each reference position. Those control particulars are executed by the controller 40 for the rotation of the motors 21 to 25.

As shown in FIGS. 4A to 4C, while the number of rotations of the bobbin 3 is "1" to 90° before "4", the nozzle holder 14 and the nozzles 12 and 13 are held at initial positions. Then, while the number of rotations of the bobbin 3 is changed from 90° before "4" to 45° before "4", the nozzle holder 14 is rotated 67.5° counterclockwise and simultaneously the first nozzle 12 is rotated 112.5° counterclockwise and the second nozzle 13 is rotated 67.5° clockwise. When the number of rotations of the bobbin 3 reaches "4" and then the bobbin 3 is rotated 135°, until the rotation reaches 180°, the nozzle 14 is rotated 112.5° counterclockwise and simultaneously the first nozzle 12 is rotated 112.5° clockwise and the second nozzle 13 is rotated 67.5° counterclockwise. Accordingly, the nozzle holder 14 and the nozzles 12 and 13 have been rotated 180° from respective initial positions. The rotations of the nozzle holder 14 and nozzles 12 and 13 are performed at the time when winding of the wires 2 reaches the end portion of the bobbin 3, that is, at the turn-back of winding operation. Under this control, the wires 2 supplied through the separate nozzles 12 and 13 can be twisted two by two.

Subsequently, until the number of rotations of the bobbin 3 reaches 90° before "7", the nozzle holder 14 and the nozzles 12 and 13 are held in the positions rotated 180° turn from the initial position. While the number of rotations of the bobbin 3 is changed from 90° before "7" to 45° before "7", the nozzle holder 14 is rotated 67.5° clockwise and simultaneously the first nozzle 12 is rotated 112.5° counterclockwise and the second nozzle 13 is rotated 67.5° clockwise. Thereafter, when the number of rotations of the bobbin 3 reaches "7" and then the bobbin 3 is rotated 135°, until the rotation reaches 180°, the nozzle 14 is rotated 112.5° clockwise and simultaneously the first nozzle 12 is rotated 112.5° clockwise and the second nozzle 13 is rotated 67.5° counterclockwise. Accordingly, the nozzle holder 14 and the nozzles 12 and 13 are returned to respective initial positions. The rotations of those nozzle holder 14 and nozzles 12 and 13 are performed at the turn-back of the winding operation after winding of the wires 2 reaches the end portion of the bobbin 3. Under this control, the wires 2 supplied through the separate nozzles 12 and 13 can be twisted two by two. Then, the same control as above is repeated until the number of rotations of the bobbin 3 reaches "15".

According to the winding apparatus 11 in the present embodiment explained as above, controlling the first to three motors 21 to 23 causes the rotation angles of the nozzle holder 14 and the nozzles 12 and 13 to be changed separately, changing the positions of a pair of two wires 2 supplied through the first nozzle 12 and the other pair of two wires 2 supplied through the second nozzle 13 relative to the bobbin 3. In the present embodiment, particularly, the wires 2 supplied through the nozzles 12 and 13 are twisted two by two at winding turn-back position of the wires 2. By the "2-2 change" winding method, the lane changes can be performed at the turn-back. This makes it possible to wind a total of four wires 2 together on the bobbin 3, and also appropriately control the four wires 2 supplied through the nozzles 12 and 13 at the turn-back of the winding operation. The rotation of the nozzle holder 14 may be associated with various rotation timings and angles of each nozzle 12 and 13 to provide different winding methods from the above "2-2 change".

Furthermore, the rectangular coil unit 1 manufactured by use of the winding apparatus 11 in the present embodiment can have a minimum coil sectional area because the four wires 2 are simultaneously wound regularly. This makes it possible to reduce eddy-current loss of the rectangular coil unit 1. Using such coil unit 1 in a motor will contribute to making the motor high-powered. Simultaneous winding of four wires 2 also allows enhanced productivity of the rectangular coil unit 1 as compared with the case where three or less wires are wound.

The present invention may be embodied in other specific forms without departing from the essential characteristics thereof.

For instance, the above embodiment shows that two wires 2 (four wires in total) are supplied through each of the first and second nozzles 12 and 13. As an alternative, it may be arranged such that two wires are supplied through the first nozzle and one wire is supplied through the second nozzle (three wires in total).

In the above embodiment, the two nozzles 12 and 13 are provided in the nozzle holder 14. Alternatively, three nozzles may be provided in the nozzle holder.

The invention claimed is:

1. A winding apparatus comprising a plurality of nozzles through which wires are supplied to a bobbin, and a nozzle holder which holds the plurality of nozzles in parallel to one another, the nozzle holder and the nozzles having parallel axes to one another, the winding apparatus being arranged to supply the wires through the plurality of nozzles to regularly wind the wires on the bobbin, wherein the winding apparatus further comprises:

first rotation devices for rotating the nozzle holder about its axis substantially, at least one of the plurality of nozzles being a multiple-wire nozzle through which a plurality of the wires is supplied, and the multiple-wire nozzle being held rotatably about its axis by the nozzle holder, and second rotation devices for rotating the multiple-wire nozzle about the axis thereof so that the nozzle holder and the plurality of nozzles are separately rotated.

2. The winding apparatus according to claim 1, wherein the plurality of nozzles are all the multiple-wire nozzles, and each multiple-wire nozzle includes the second rotation means devices.

3. The winding apparatus according to claim 2, wherein two of said multiple-wire nozzles are provided, each of which is configured to allow two wires to pass therethrough.

* * * * *

UNITED STATES PATENT AND TRADEMARK OFFICE

CERTIFICATE OF CORRECTION

PATENT NO. : 7,614,579 B2
APPLICATION NO. : 12/084435
DATED : November 10, 2009
INVENTOR(S) : Mitsutoshi Asano It is certified that error appears in the above-identified patent and that said Letters Patent is hereby corrected as shown below:

| Column | Line | |
|---|---|---|
| 5 | 56 | Change "NIA" to --N1A--. |
| 8 | 18 | Before "devices" delete "means". |

Signed and Sealed this

Eleventh Day of May, 2010

David J. Kappos

David J. Kappos
*Director of the United States Patent and Trademark Office*